US007056195B2

(12) United States Patent
Evans

(10) Patent No.: US 7,056,195 B2
(45) Date of Patent: Jun. 6, 2006

(54) APPARATUS AND METHOD FOR SHARPENING TOOL BLADES

(76) Inventor: Geoffrey John Hamilton Evans, 35 Eleventh Avenue, Rivonia, Sandton (ZA) 2128

( * ) Notice: Subject to any disclaimer, the term of this patent is extended or adjusted under 35 U.S.C. 154(b) by 0 days.

(21) Appl. No.: 10/944,336

(22) Filed: Sep. 16, 2004

(65) Prior Publication Data

US 2006/0057946 A1 Mar. 16, 2006

(51) Int. Cl.
*B24B 3/00* (2006.01)

(52) U.S. Cl. ..... 451/45; 451/378; 451/370

(58) Field of Classification Search ..... 451/367, 451/370, 371, 378, 386, 391, 45
See application file for complete search history.

(56) References Cited

U.S. PATENT DOCUMENTS

| | | | | |
|---|---|---|---|---|
| 103,739 | A * | 5/1870 | Hanks | 451/370 |
| 210,957 | A * | 12/1878 | Olsen | 451/370 |
| 418,781 | A | 1/1890 | Blakeslee | |
| 494,504 | A * | 3/1893 | Bock | 451/370 |
| 560,111 | A * | 5/1896 | Salot | 451/370 |
| 729,319 | A * | 5/1903 | Fowler | 451/370 |
| 1,239,494 | A * | 9/1917 | Lange | 451/370 |
| 2,346,300 | A * | 4/1944 | Guy | 451/391 |
| 2,740,241 | A | 4/1956 | McCubbin | |
| 3,950,899 | A * | 4/1976 | Gilbert | 451/370 |
| 4,217,735 | A | 8/1980 | McGeoch et al. | |
| 4,733,501 | A | 3/1988 | McLean | |
| 5,582,542 | A | 12/1996 | Stein | |

FOREIGN PATENT DOCUMENTS

| | | |
|---|---|---|
| DE | 526 996 C | 6/1931 |
| JP | 10-44001 | 2/1998 |
| WO | WO 2004/091860 A2 | 10/2004 |

* cited by examiner

*Primary Examiner*—Robert A. Rose
(74) *Attorney, Agent, or Firm*—Fulwider Patton LLP

(57) ABSTRACT

A sharpening device for the blade of a tool such as a chisel or plane is in two parts. The first is a jig into which the blade is inserted with its tapered end projecting some distance beyond the jig. This distance is related to the angle to which the blade is to be sharpened. The second part is a marked reference member which is brought into a position alongside the jig. The blade is advanced through the jig until its tip reaches a marking on the reference member corresponding to the required sharpening angle for the tool. The tool is then clamped in the jig. The jig incorporates a roller which rolls on the sharpening stone while the tapered tip of the blade is sharpened by contact with the stone.

11 Claims, 6 Drawing Sheets

APPARATUS AND METHOD FOR SHARPENING TOOL BLADES

FIELD OF THE INVENTION

This invention relates to a sharpening device for the blades of tools such as chisels and hand planes, as used by woodworkers and other craftspeople. The invention provides a simple, convenient, and accurate device for sharpening the angled edges on the blades of these tools, whether the blades are flat or tapered.

BACKGROUND OF THE INVENTION

Experienced craftspeople spend a good deal of time sharpening their tools, since the best results are generally obtained with very sharp tools, and sharp edges are rapidly blunted when the tools are in use.

If the craftsperson is skilled at sharpening these tools, only a relatively few strokes of the tool on a sharpening stone are needed to sharpen it, particularly if the tool has a primary sharpening angle and, at its very tip, a micro-edge at an angle somewhat higher than the primary angle. However, even an experienced craftsperson gains by using a jig or other sharpening device to steady the tool and hold it at the correct angle to the stone, since a hand-held tool tends to rock during sharpening with the result that metal is unnecessarily removed and the sharpening operation sometimes becomes problematic and unduly time-taking.

It is desirable to conserve the metal of the tool since the blade will otherwise be prematurely shortened, making it eventually unfit for its intended purpose, or, if the blade is tapered along its full length, reaching a stage where its working end is excessively thick. Efficiency in sharpening is therefore important.

It is crucial that there be a high degree of consistency in the way in which a tool is sharpened, so that, even if the angle to which it is sharpened is not perfectly correct, the angle is precisely replicated each time the tool is sharpened.

Sharpening angles are generally within the range 15 degrees to 60 degrees, measured as the included angle between the rear face of the tool (which for present purposes will be regarded as the face on which the sharp edge is provided) and the tapered zone at the tip of the blade. The front face will for present purposes be regarded as the face from which the tapered zone extends at an oblique angle towards the sharp edge of the tool. If the blade has a micro-edge, this edge extends from the rear face of the tool a short distance up the taper of the tip.

If a tool is short and the sharpening angle is in the lower part of the range, below about 30 degrees, access to its front face during sharpening is limited, and only compact structures can be accommodated in the space between the surface of the stone and the front face of the tool. This imposes a significant challenge to the designer of sharpening devices.

Moreover, since workshop space is usually limited, it is usually only possible to allocate a relatively small space on a bench or other work-top to the sharpening of tools. It is consequently desirable to have a single sharpening device for all the relevant tools in a workshop, capable of working with both low and high sharpening angles and with both flat and tapered blades, and which occupies only a minimal space. It is also important that the procedures involved in using the sharpening device be as brief and simple as possible, so that efficient use of workshop time is promoted.

While many sharpening devices have been proposed, only a few have had enduring success on the market. One of these, described in U.S. Pat. No. 4,733,501 (McLean), is in two parts. The first part comprises a cylindrical roller which in use runs backwards and forwards along a sharpening stone and which rotates about a shaft to which is attached a blade-holder including a flat clamping plate and a hand-screw mounted in a bracket located above the clamping plate. The hand-screw is used to engage the rear face of the blade and clamp the front face of the tool on to the clamping plate. The sharpening angle is set by aligning the rear face of the blade with one of the planar faces of a multi-faced block which is clamped by a further hand-screw to a base plate on which the setting up of the blade in the device takes place. The base plate and the multi-faced block mounted on it make up the second part of the device. The block, when loosened from the base plate by use of the hand-screw on this component, is rotatable between different positions on the base plate to expose different faces which make different included angles with the plane of the base plate. These angles are chosen to match the most common sharpening angles of planes and chisels, so that the device can accommodate a number of different angular settings for blades to be sharpened. Once the block has been set and locked in the desired position on the base place, the blade is positioned against the appropriate face of the block, in full surface-to-surface contact with it, with the tip of the blade engaging the base plate. The other part of the tool is then brought into position on the base plate, the hand-screw on that component having been loosened for this purpose. In the final position the roller rests on the base plate and the front face of the blade engages the clamping plate. The hand-screw is then tightened so that the blade is fixed relative to the clamping plate and consequently to the roller. The blade, with the first part of the device attached in this fashion, is then moved on to a sharpening stone, such as a whetstone or an oilstone, and is pressed on to it while the blade and the roller are made to run backwards and forwards on its surface until sharpening has been achieved. The mountings of the roller on the first part of the device include an eccentric mechanism to allow the roller to be moved relative to the blade to a position where the tool assumes a greater included angle to the plane of the stone than the original angle to which the device had been set, so that a micro-tip can be ground on to the blade by further rolling action.

While the device of U.S. Pat. No. 4,733,501 is considerably simpler than many other sharpening devices which have been proposed, it suffers from the disadvantage that the setting up operation, involving the clamping of the block on the base plate at one of the angles defined by its various faces and then positioning the blade alongside this face before bringing the other part of the device into operation, is both somewhat time-taking and error-prone, since it can usually be done with only one hand, the operator's second hand being occupied with mounting the blade in the first part of the device and then clamping it on to the clamping plate. The number of sharpening angles which the device can provide is also limited to the number of faces on the multi-faced block.

Other known sharpening devices tend to be considerably more complicated. For example, U.S. Pat. No. 5,582,542 (Stein) discloses a device which incorporates a base on which a sharpening stone is moved backwards and forwards, or sideways, relative to a blade which is clamped in a holder which is mounted on the base. The holder comprises an arm with an end part that is articulated to the rest of the arm, the blade being clamped to this end part with its rear face uppermost. The arm is rotated into the selected position and then locked in this position for the sharpening operation.

This arrangement leaves the tapered surface of the blade located parallel to the plane of the base plate, so that the movement of the stone on the base plate provides an abrading action on the tapered zone of the blade. No guidance is provided as to how to set up the device for any particular sharpening angle, and in practice that task must be undertaken by the use of another tool, such as a protractor. The device as a whole is relatively bulky and takes up a considerable space on a workbench or elsewhere in a workshop.

Another relatively bulky and complicated sharpening device is described in U.S. Pat. No. 4,217,735 (McGeoch), where a blade to be sharpened is also clamped relative to a fixed superstructure and a sharpening stone is reciprocated underneath the blade to abrade its tapered tip.

Thus, a need exists for an improved apparatus and method to provide a sharpening device for plane blades, chisel blades (whether flat or tapered), and the blades of similar tools, which is compact and simple to operate and allows quick and accurate selection of any sharpening angle within the normal range for this type of tool. It is believed that the present invention addresses these and other needs.

SUMMARY OF THE INVENTION

According to a preferred embodiment of the invention, a sharpening device for the blade of a tool with a tapered tip comprises a jig on which a rotatable roller is mounted, means to clamp the blade releasably to the jig with the axis of the roller parallel to the edge of the tool, and a reference member adapted to be located alongside and in contact with the jig and being provided with graduated markings corresponding to various sharpening angles, the blade being movable relative to both parts of the device into a selected position where its edge is located at one of the markings on the reference member, in which position the blade can be clamped by an operator to the jig, with the selected marking on the reference member corresponding to the desired sharpening angle for the blade.

The device may conveniently include means to hold the jig and the reference member together in a registration position while the blade is moved into the selected position relative to both of them before being clamped.

The reference member preferably includes a plate having a flat surface on which the markings are provided.

The jig preferably comprises a frame which includes a clamping plate adapted to engage the rear surface of the blade and means to clamp the blade to the clamping plate. If the reference member has a flat surface, the clamping plate is preferably co-planar with the flat surface of the reference member when the two parts of the device are brought together in the registration position for a blade to be located in the device and clamped to the jig.

The means to locate the jig in the registration position relative to the reference member of the device conveniently comprises a lug projecting from the reference member and forming a seat on which the jig can rest. A pair of pins on one of the parts of the device, registering with corresponding holes in the other part, may conveniently form the means to hold the two parts of the device in the registration position.

In a preferred form the means to secure the blade releasably to the clamping plate comprises a pressure plate located between the roller and the clamping plate, and means to move the pressure plate into a position in which it engages the front surface of the blade and forces the rear surface of the blade into clamping contact with the clamping plate. The latter means may conveniently be a pair of threaded studs fixed one at each end of the pressure plate and passing freely through registering holes in the frame, with a hand-screw nut located on the end of each stud where it projects beyond the frame. The clamping plate occupies at least some of the space between these studs. In use, the blade is then clamped to the clamping plate, in the space between the studs, by tightening the nuts of the hand-screws.

In order to conserve space in the region between the roller and the clamping plate, which is necessarily a limited space, the pressure plate may conveniently be a segment of a cylinder, with an arcuate concave surface facing the roller and an arcuate convex surface engaging the front surface of the blade. This configuration allows the device to be successfully used with both flat and tapered blades, such as the tapered blades of some specialised chisels. If the holes in the frame for the studs of the hand-screws are made sufficiently large to provide a modicum of clearance, the surface of the sliding plate adjacent the clamping plate can be flat, with only its opposite surface being hollowed to follow the curvature of the roller. This simplifies the making of the pressure plate.

In practice, for chisels and planes commonly used in joinery, the roller should be relatively small in diameter. A suitable diameter is 12 mm or thereabouts. The roller may conveniently be made of Vesconite™ or brass, or some other material which resists corrosion since, if wet sharpening is used, the roller will frequently be immersed in the slurry which forms on the surface of the stone and which contributes to the sharpening process. If the roller is of 12 mm diameter, a suitable distance of the clamping plate from the axis of the roller is 17 mm or thereabouts. Seals may be provided on the mountings of the roller to prevent the ingress of liquids and fine particulate material generated during sharpening, or slurries of both.

Calculation of the positions for the markings on the reference member is a matter of applying standard trigonometrical formulae, with the diameter of the roller and the distance of the axis of the roller perpendicularly from the plane of the clamping plate being fixed parameters and the sharpening angle being a given. It is obvious that the markings nearer the edge of the reference plate adjacent the clamping plate of the jig will represent the higher sharpening angles, up to say 60 degrees, while the sharpening angle will decrease the further the markings are located from that edge, say to a point representing 15 degrees.

The markings on the reference member are conveniently lines across its surface located so that the edge of the blade may be positioned along a line corresponding to the selected sharpening angle, at least some of the lines being marked with the relevant number of degrees which they represent. The numbers may conveniently be placed at each end of a line.

Some lines at right angles to the lines representing sharpening angles may also be provided on the reference member to aid in setting a narrow blade accurately at right angles to a line representing the required sharpening angle.

These and other advantages of the invention will become more apparent from the following detailed description thereof and the accompanying exemplary drawings.

DETAILED DESCRIPTION OF THE PREFERRED EMBODIMENTS

Figure 1:
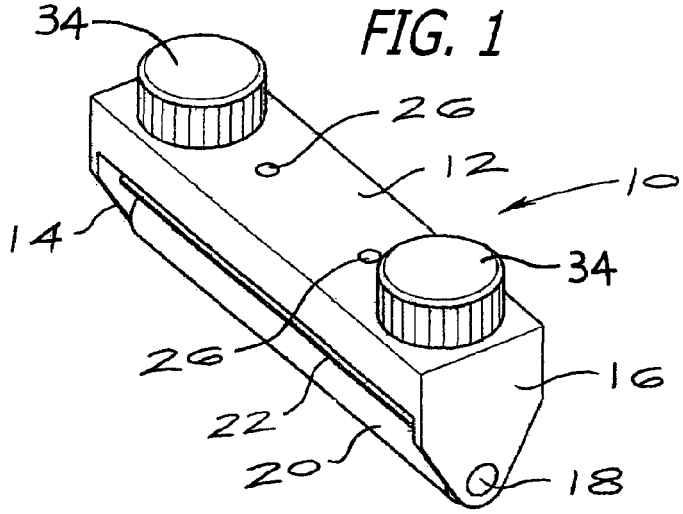
FIG. 1 is an isometric view of a jig showing aspects of the invention for sharpening the blade of a tool with a tapered tip.

With reference to the Figures, a first aspect according to a preferred embodiment of the present invention is described, namely, a jig, generally referred to by the numeral 10. In general terms, the jig 10 illustrated in the figures comprises a frame with a central platform 12 and, at right angles to it, limbs 14 and 16. Fixed to and extending between the limbs 14 and 16 is a shaft 18 on which a cylindrical roller 20 is mounted for rotation about the shaft. Seals 19 may be provided between the roller 22 and the shaft 18 to exclude moisture and detritus.

Figure 2:
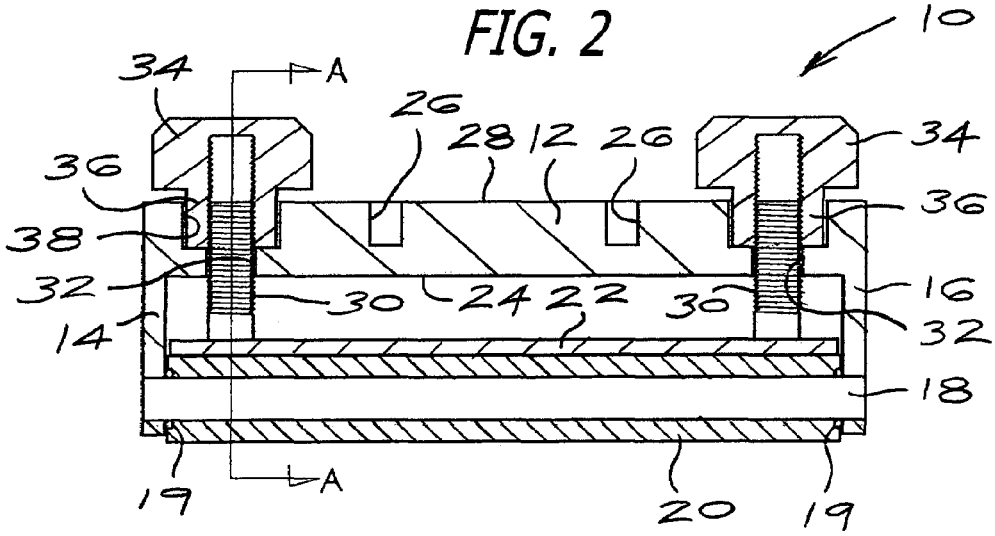
FIG. 2 is a view of the jig of FIG. 1 sectioned along its central longitudinal plane.
Figure 3:
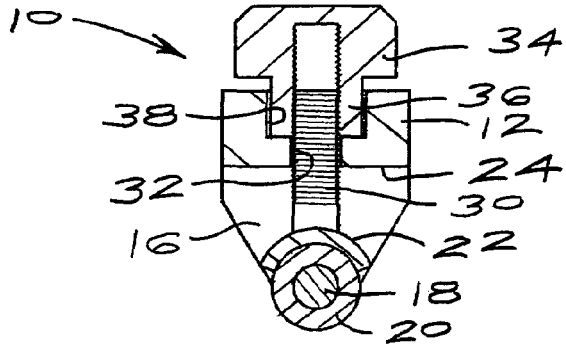
FIG. 3 is a transverse sectioned view of the jig of FIGS. 1 and 2, taken along the line A—A in FIG. 2.

A pressure plate 22 in the form of a sector of a hollow cylinder is located between the roller 20 and a surface 24 of the platform 12 juxtaposed with the roller (FIGS. 2, 3). The surface 24 acts as a clamping plate, as is explained below. Two blind holes 26 are provided in the opposite surface of the platform 12.

Threaded studs 30 fixed at one end to the pressure plate 22 extend through holes 32 in the platform 12, with hand-screw nuts 34 threaded on to their free ends. The nuts have knurled cylindrical surfaces for easy gripping, and have projecting spigots 36 that extend into, and are a free fit within, counter-drilled seats 38 in the platform 12.

Figure 4:
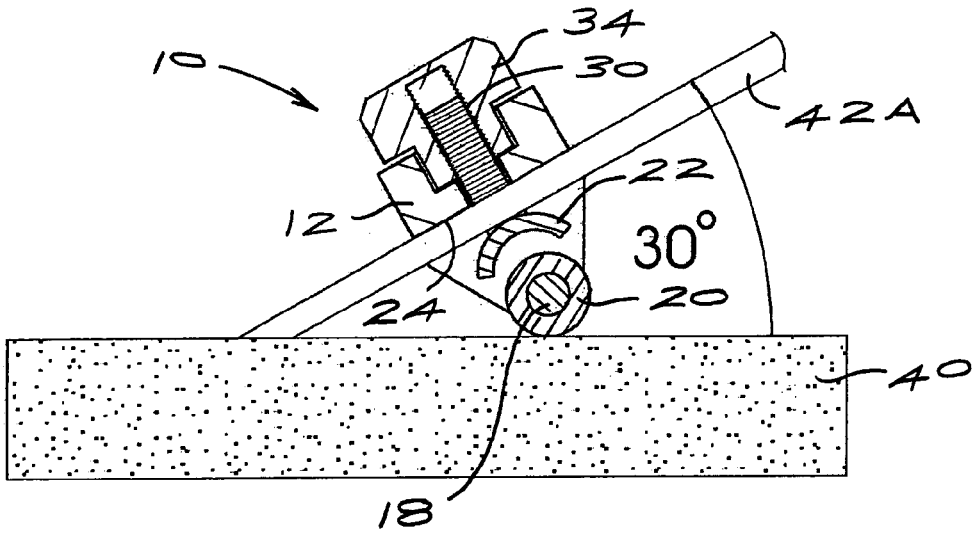
FIG. 4 is a view, corresponding to FIG. 3, of the jig of FIGS. 1–3 in use to sharpen a tapered chisel blade with a 30-degree taper at its tip, the blade being clamped to the jig. A roller which forms part of the jig, and the tip of the chisel, are seen in contact with a sharpening stone.

With reference to FIG. 4, the jig 10 is shown in action on a sharpening stone 40, with a tapered chisel blade 42A clamped against the clamping plate 24 by the pressure plate 22, which has been drawn into the clamping position by the operator. The axis of the roller 20 is parallel to the edge to be sharpened on the blade 42A. The operator locks the blade in position on the jig by tightening the hand-screw nuts 34 on the studs 30 to cause the pressure plate 22 to engage the front face of the chisel (i.e. the surface juxtaposed to the stone 40) and draw the pressure plate 22 toward the clamping plate 24. This causes the rear face of the chisel (i.e. the surface on which the sharp edge of the chisel is found) to engage and be held in surface-to-surface contact with the clamping plate 24. The sharpening angle has been set in FIG. 4 at 30 degrees, which is the included angle between the planar surface of the stone 40 and the rear face of the chisel 42A. The tapered tip of the chisel 42A can accordingly be sharpened at the correct angle by rolling the jig and chisel blade backwards and forwards on the stone 40. The stone may either be of the type that is moistened with water for optimum results, which are achieved when a slurry forms on the surface of the stone after some action on it, or may be an oilstone to which oil is applied.

Figure 5:
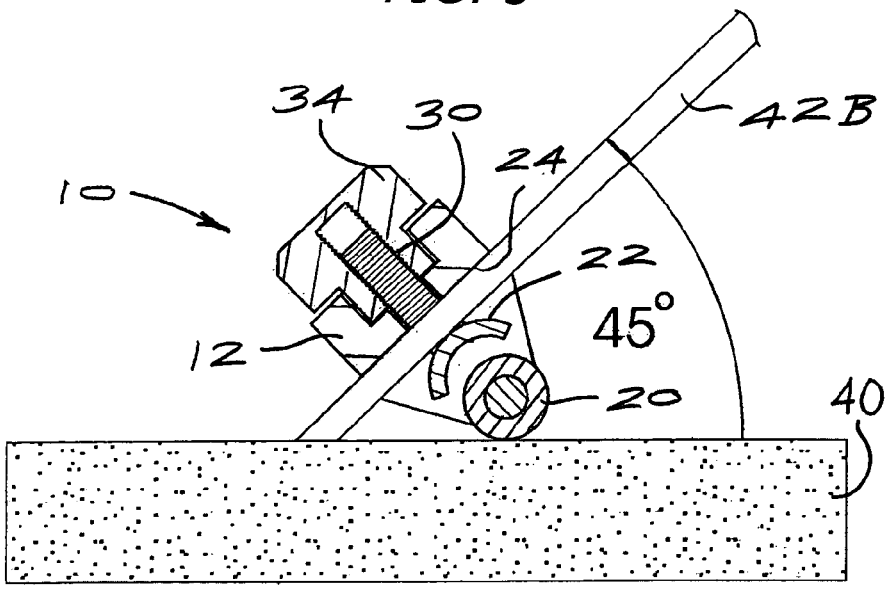
FIG. 5 is a view corresponding to FIG. 4 but in which the sharpening angle is 45 degrees.

FIG. 5 exemplifies a similar arrangement in relation to a tapered chisel 42B which is to be sharpened at a sharpening angle of 45 degrees.

It will be noticed that, in FIG. 5, the portion of the blade 42B that projects beyond the jig 10 and is in contact with the stone 40 is considerably shorter than the corresponding portion in FIG. 4. The length of the projecting portion of the blade is obviously the decisive factor in setting the sharpening angle.

Figure 6:
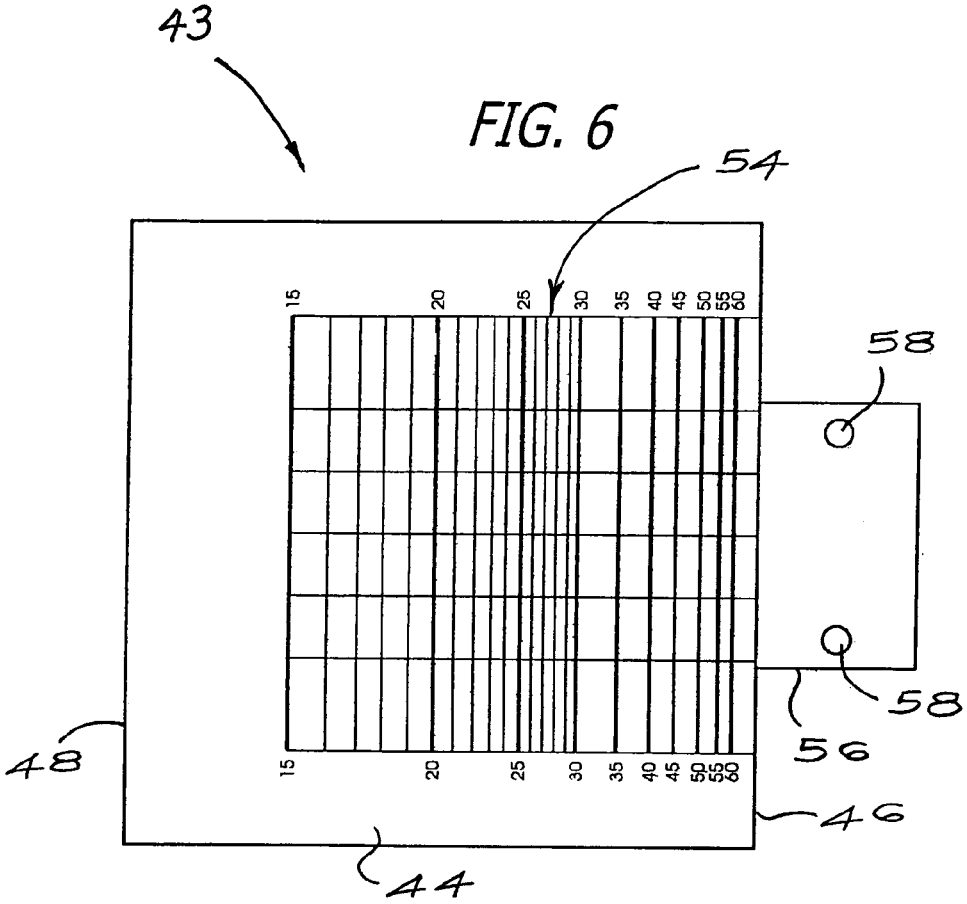
FIG. 6 is a plan view of a reference member which co-operates with the jig of FIGS. 1–5 in an initial phase in which the sharpening angle is selected.
Figure 7:
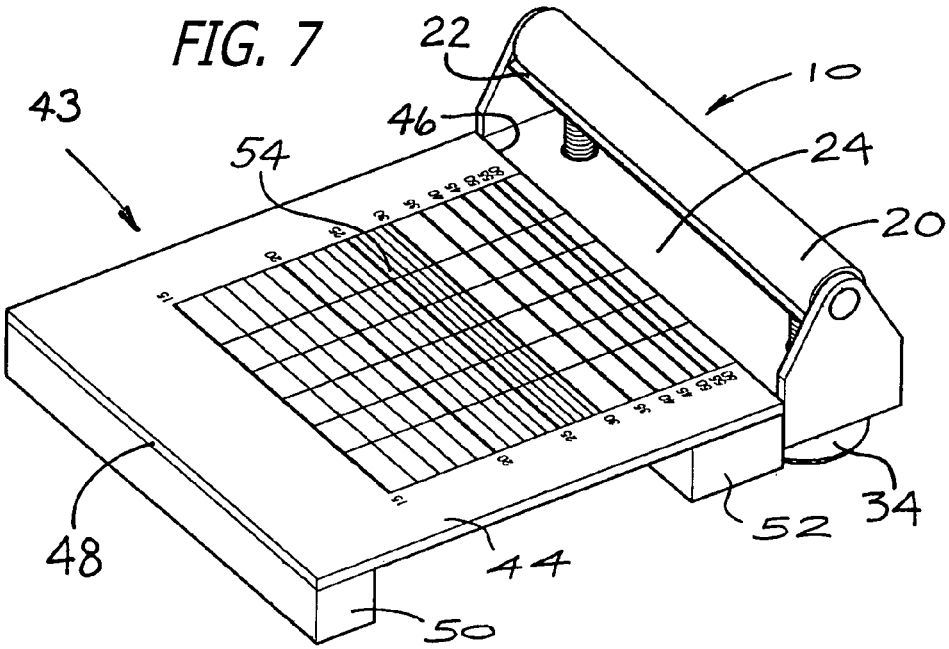
FIG. 7 is an isometric view of the jig and reference member of the preceding Figures located in a fixed relationship in which they are ready for the introduction of a tool blade and the selection of a sharpening angle for the blade.
Figure 8:
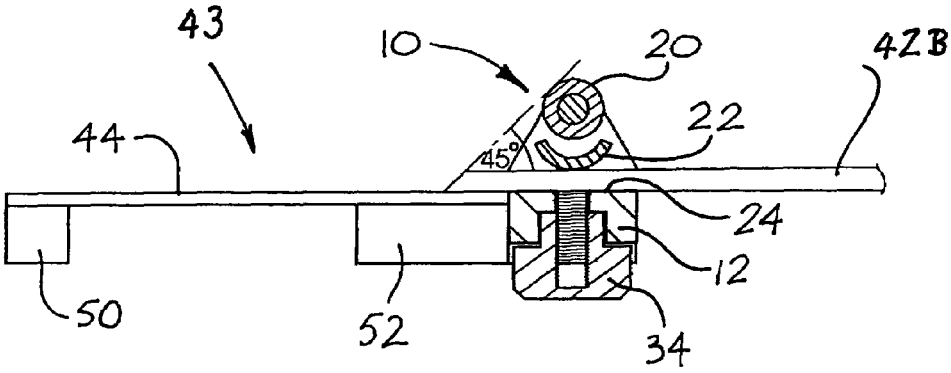
FIG. 8 is a sectioned elevation view of the same jig and reference member as are seen in FIG. 7, with a chisel blade in place for sharpening at an angle of 45 degrees.
Figure 9:
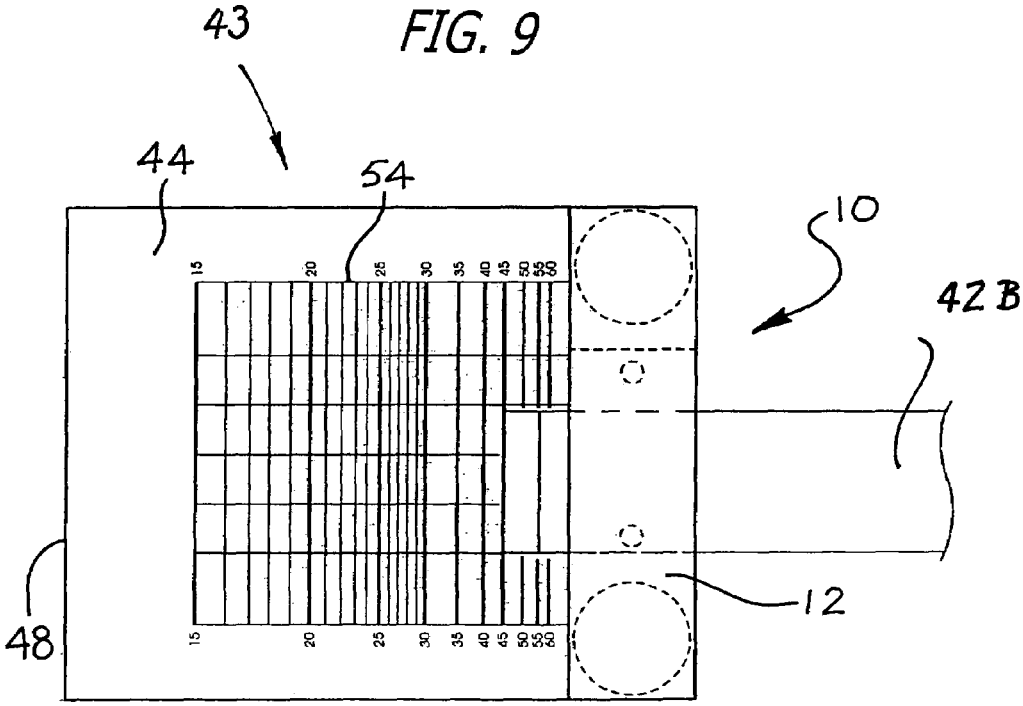
FIG. 9 is a plan view of the device and chisel blade of FIG. 9.
Figure 10:
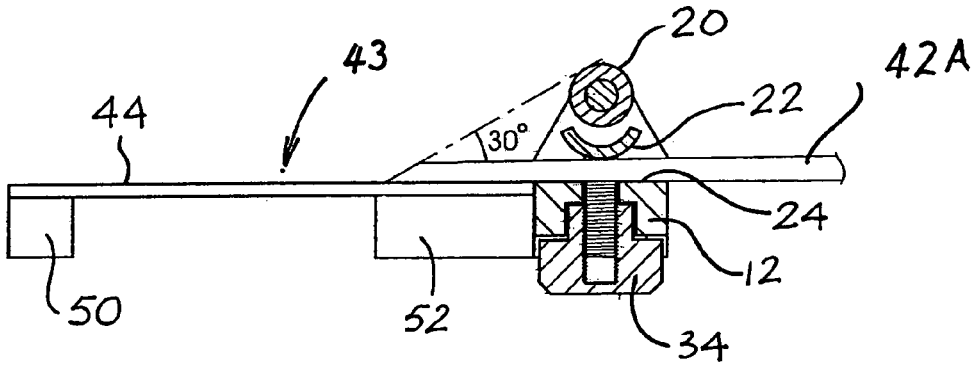
FIGS. 10 and 11 are views corresponding to FIGS. 8 and 9 respectively, but with the sharpening angle of the chisel set at an angle of 30 degrees.
Figure 11:
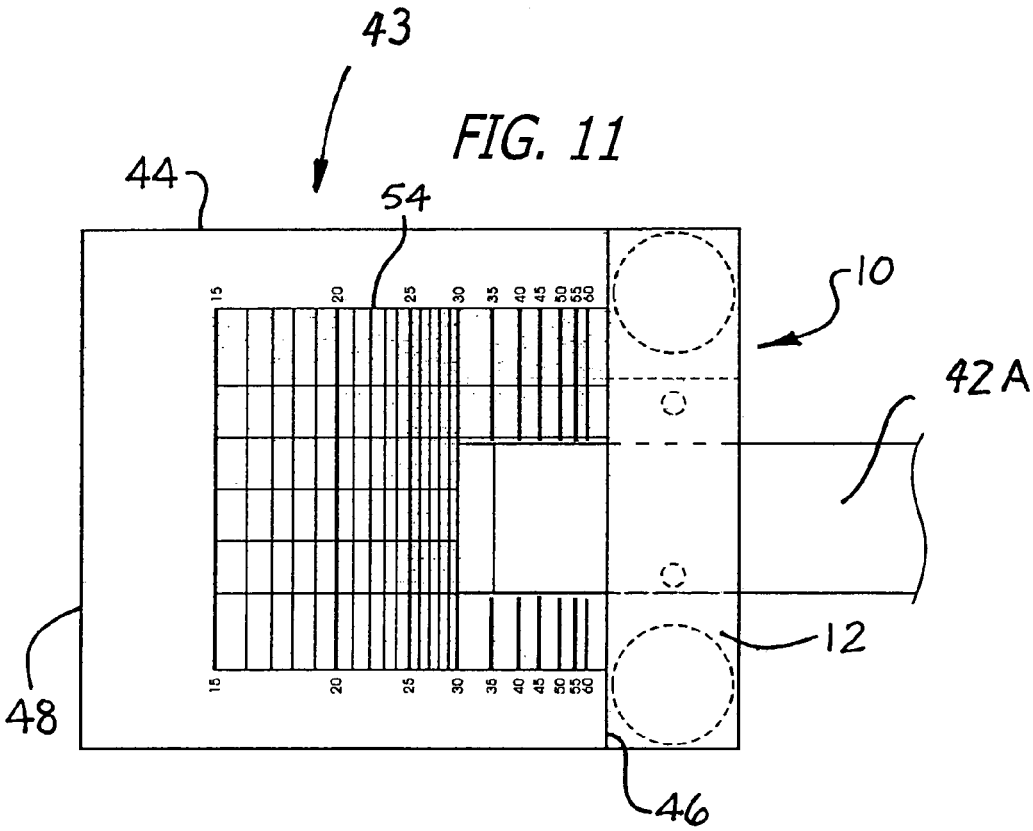

With reference to FIG. 6 et seq., there is exemplified a further aspect of the invention, namely a reference member, generally referred to by the numeral 43, which is used to determine the length of the projecting portion of the blade from the jig for any desired sharpening angle. The reference member 43 includes a rectangular plate 44 to the undersurface of which may be fixed, along what are in use its front edge 46 and rear edge 48, two battens 50 and 52 respectively which serve to raise the plate 44 above the surface of a bench or work-top on which it is located. The upper surface of the plate 44 is provided with markings, indicated generally by the numeral 54, which take the form of a grid of lines parallel to, and at right angles to, the front and rear edges 46, 48 of the plate. The lines parallel to these edges represent sharpening angles between 15 degrees and 60 degrees. Those representing the higher degrees in this range are nearer the front edge 46 and those representing the lower degrees are nearer the rear edge 48. The lines at right angles to these lines are locating lines for lining up the side edges of the blades to be sharpened. Numerals representing the various angles are marked next to each end of selected lines, e.g. at five-degree steps.

The reference member 43 forms a reference element for setting the correct sharpening angle for a tool to be sharpened using the jig 10, at any selected angle, preferably between 15 and 60 degrees.

A lug 56 projects forwardly from the batten 52 below the upper surface of the plate 44, being so located that its upper surface is spaced below the upper surface of the plate 44 by a distance equal to the thickness of the platform 12 of the jig 10. Two pins 58 are provided in its upper surface, spaced from each other to register with the holes 26 in the platform 12 of the jig 10 and dimensioned to fit snugly within those holes.

To arrange the device for use, the reference member 43 is attached to a worktop (not illustrated) either by bolting it in place or, for example, by fixing the batten 50 in a vice. The lug 56 projects beyond the edge of the worktop. The jig 10 is then placed on the lug 56 in an orientation in which the pins 58 projecting upwards from the lug 56 enter and become seated in the holes 26 in the platform 12 of the jig. An edge of the platform 12 engages the front end 46 of the reference plate 44. The hand-screw nuts 34 are at this stage located below the level of the lug 56. In this position the clamping plate 24 of the jig is co-planar with the upper surface of the reference plate 44.

The hand-screw nuts 34 are loosened to create freedom of movement of the pressure plate 22 relative to the clamping plate 24 of the jig. The operator orients the blade to be sharpened with its front face uppermost and slides the blade, from the free side of the jig, into the space between the pressure plate 22 and the clamping plate 24 on to the reference plate 44. The pressure plate 22 rises to the extent necessary for this process. The operator moves the blade into a position in which its sharp edge coincides with the grid line 54 marked on the reference plate 44 corresponding to the desired sharpening angle. The operator then tightens the two hand-screw nuts 34 to cause the pressure plate 22 to clamp the blade against the clamping plate 24 of the jig, so that it is securely held in the jig.

The jig and the tool clamped in it are then moved on to a sharpening stone to assume a configuration generally similar to that shown in FIGS. 4 and 5, with the blade now positioned at the desired sharpening angle.

Once the tool has been sharpened, it is freed from the jig 10 by loosening the hand-screw nuts 34 and sliding the blade free of the jig.

If a micro-tip is required on the blade at an angle higher than that of the tapered zone, the set-up procedure is repeated to select the correct angle for the micro-tip. The tool is then located once more on the stone and rolled further on it until the micro-tip has been created.

It will be appreciated that the device is extremely compact, both when it is in use and when stored. Set-up of a blade in the jig to ready it for sharpening can be carried out in the minimum of time and with a minimal possibility of error. The only adjustment necessary when different sharpening angles are required, whether on the same or different blades, it to slide the tip of the blade, during the set-up operation, to the line representing the selected sharpening angle.

Suitable materials for the main components of the device are brass, which is rigid and stable and resists corrosion, and Vesconite™ for the roller. Other materials can however be used.

Wear in the device may be negligible, even with extended use, and it may last indefinitely if handled with basic care.

Figure 12:
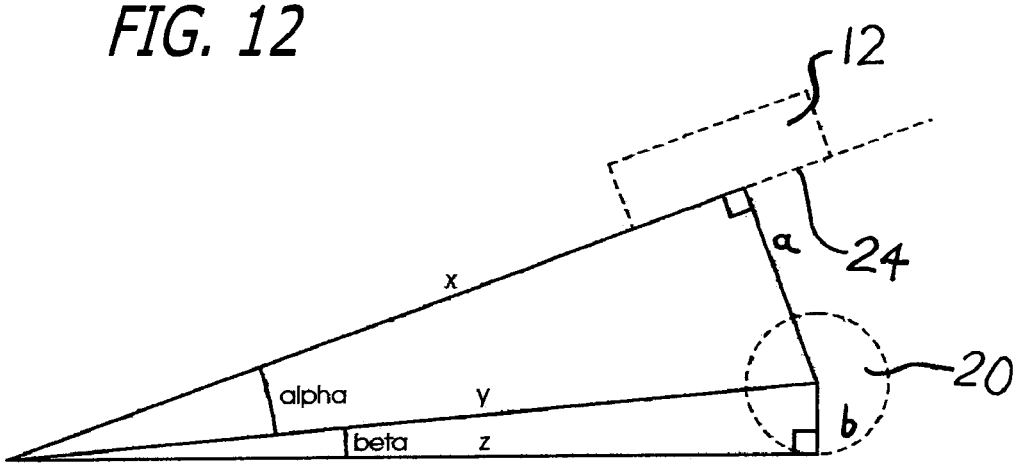
FIG. 12 is a diagram which illustrates the basic geometry of an embodiment of the invention, used to determine the positions of the markings for the various sharpening angles on the reference plate of FIG. 6 et seq.

The calculations underlying the graduated markings 54 on the reference plate 44 are based on the geometry of the diagram forming FIG. 12.

With reference to FIG. 12, the letter "a" represents the perpendicular distance between the axis of the roller 20 and the clamping surface 24 on the platform 12 of the jig, and "b" represents the radius of the roller 20. The letter "x" represents the distance between the point of intersection of the line "a" with the clamping surface 24 and the edge of the blade to be sharpened, "y" represents the line extending between the axis of the roller 20 and the edge of the blade to be sharpened, and "z" represents the distance between the point of contact of the roller 20 with the surface of the sharpening stone and the edge of the blade to be sharpened. The included angle between the lines x and y is indicated as alpha and the included angles between the lines y and z as beta.

It should be noted that the included angles between the lines a and x, and between b and z, are right angles.

The angle (alpha+beta) is the included angle between the sharpening stone and the rear face of the blade to be sharpened.

The line y is the hypotenuse of the both the triangles defined by the lines z and x, and b and z.

If a is taken as 6 mm and b as 17 mm, which are representative figures in practice, then for any given value of (alpha+beta), corresponding to a possible sharpening angle, the value of x can be calculated from standard trigonometrical calculations. It is assumed for the tables of data set out below that the platform 12 of the jig 10 has a transverse width of 25 mm, which is also a representative figure in practical conditions. The line a meets the surface 24 midway across its width, so that in practice the sharp edge of the tool projects from the jig by a distance of (x−12.5) mm.

Applicable values for x corresponding to sharpening angles ranging from 15 degrees to 60 degrees, at intervals of 5 degrees, are set out in Table 1 below.

The distance by which the tool blade projects beyond the jig, i.e. the distance (x−12.5) mm, is also set out in Table 1. The markings on the reference plate 44 applicable to any desired sharpening angle thus match the distance (x−12.5) mm for that angle.

TABLE 1

| Sharpening angle (alpha + beta) (degrees) | distance x (mm) | distance (x − 12.5) (mm) to one decimal place |
|---|---|---|
| 60 | 16.7429 | 4.2 |
| 55 | 19.2280 | 6.7 |
| 50 | 22.0970 | 9.6 |
| 45 | 25.4851 | 13.0 |
| 40 | 29.5940 | 17.1 |
| 35 | 34.7390 | 22.2 |
| 30 | 41.4447 | 28.9 |
| 25 | 50.6536 | 38.2 |
| 20 | 64.2497 | 51.7 |
| 15 | 86.6268 | 74.1 |

For convenience, since sharpening angles between 15 degrees and 30 degrees are commonly encountered in practice, the corresponding data for one-degree differences are provided in Table 2 below.

TABLE 2

| Sharpening angle (alpha + beta) (degrees) | distance x (mm) | distance (x − 12.5) (mm) to one decimal place |
|---|---|---|
| 30 | 41.4447 | 28.7 |
| 29 | 43.0446 | 30.5 |
| 28 | 44.7525 | 32.7 |
| 27 | 46.5803 | 34.1 |
| 26 | 48.5420 | 36.0 |
| 25 | 50.6536 | 38.2 |
| 24 | 52.9340 | 40.4 |
| 23 | 55.4051 | 42.9 |
| 22 | 58.0931 | 45.6 |
| 21 | 61.0289 | 48.5 |
| 20 | 64.2497 | 51.7 |
| 19 | 67.8008 | 55.3 |
| 18 | 71.7331 | 59.2 |
| 17 | 76.1254 | 63.6 |
| 16 | 81.0537 | 68.6 |
| 15 | 86.6268 | 74.1 |

While a particular form of the invention has been illustrated and described, it will also be apparent to those skilled in the art that various modifications can be made without departing from the spirit and scope of the invention. Accordingly, it is not intended that the invention be limited except by the appended claims.

I claim:

1. A method of preparing a tool blade for sharpening a tip thereof to a desired angle, comprising:

attaching the tool blade to a jig such that a length of the blade extends beyond the jig and such that the tip is positioned at an extremity of the blade, whereby the angle formed between a plane of the blade and a straight line extending from the tip to a tangential point on the jig is the angle to which the tip is to be sharpened;

attaching to a worktop a reference member bearing a plurality of graduated markings for measuring the length of the blade extending beyond the jig;

removably securing the jig to the reference member such that the distance between the jig and each marking is predetermined; and measuring the distance from the tip to the jig, whereby said angle may be determined from the measurement and from known geometry of the jig.

2. The method of claim 1, wherein attaching the reference member to a worktop includes bolting the reference member to a worktop.

3. The method of claim 1, wherein attaching the reference member to a worktop includes fixing the reference member in a vice.

4. The method of claim 1, wherein the reference member includes a pin and the jig includes a hole formed in a surface of the jig, and wherein removably securing the jig to the reference member includes inserting the pin on the reference member within the hole in the jig.

5. The method of claim 4, wherein inserting the pin within the hole in the jig includes holding the jig in position relative to the reference member.

6. A method of preparing a tool blade for sharpening a tip thereof to a selected angle in a range, comprising:

locating the tool blade in a jig which includes a roller so that a portion of the blade including the tip extends beyond the jig and so that an acute angle is formed between a plane defined by a surface of the blade extending along its length to its tip and a plane extending from the tip tangentially to the roller;

attaching to a worktop a reference member bearing a plurality of graduated markings to indicate the length of the portion of the blade extending beyond the jig, the markings corresponding to the required range of sharpening angles;

bringing the jig into a registration position in relation to the reference member, in which position the jig is held in place by inter-engaging mating formations on the jig and the reference member;

moving the blade in relation to the jig and the reference member into a position in which the tip is located at a marking on the reference member corresponding to the selected sharpening angle for the tip;

clamping the blade in the jig in the said position;

removing the jig from the reference member with the blade clamped in the jig; and locating the jig on a sharpening stone with the roller and the tip of the blade in contact with the stone.

7. A device for holding and positioning a tipped tool blade for sharpening the tip on a sharpening stone at a sharpening angle selected from a required range of sharpening angles, the device comprising:

a jig to hold the blade during sharpening in a position relative to the sharpening stone appropriate for the sharpening angle selected; and a reference member, to facilitate initial positioning of the blade relative to the jig in a position appropriate for the sharpening angle selected;

wherein, the jig comprises:

a platform;

a roller mounted on the platform for rotation about an axis and being adapted to roll on a sharpening stone during a sharpening operation;

a clamp adapted to hold the blade on the platform in a position in which the tip of the blade projects beyond the jig by a distance selected according to the sharpening angle selected; and wherein the reference member is adapted to be located, for initial positioning of the blade relative to the jig, in a registration position relative to the jig;

the reference member has a surface which bears a series of graduated markings in a zone which, when the reference member is in the registration position and during use of the device, is adjacent the tip of the blade so that the blade may be positioned relative to the jig with the tip of the blade located at a selected marking; and the markings correspond to different sharpening angles in the required range;

the jig and the reference member include co-operating structures to releasably hold the jig and the reference member together in the registration position; and the co-operating structures include a lug projecting from the reference member, the lug forming a seat adapted to engage the jig during use of the reference member, and wherein the co-operating structures include mating pins and holes defined on a surface of the lug and on a juxtaposed portion of the jig which engages the lug.

8. A device for holding and positioning a tipped tool blade for sharpening the tip on a sharpening stone at a sharpening angle selected from a required range of sharpening angles, the device comprising:

a jig to hold the blade during sharpening in a position relative to the sharpening stone appropriate for the sharpening angle selected; and a reference member, to facilitate initial positioning of the blade relative to the jig in a position appropriate for the sharpening angle selected;

wherein, the jig comprises:

a platform;

a roller mounted on the platform for rotation about an axis and being adapted to roll on a sharpening stone during a sharpening operation;

a clamp adapted to hold the blade on the platform in a position in which the tip of the blade projects beyond the jig by a distance selected according to the sharpening angle selected; and wherein, the reference member is adapted to be located, for initial positioning of the blade relative to the jig, in a registration position relative to the jig;

the reference member has a surface which bears a series of graduated markings in a zone which, when the reference member is in the registration position and during use of the device, is adjacent the tip of the blade so that the blade may be positioned relative to the jig with the tip of the blade located at a selected marking;

the markings correspond to different sharpening angles in the required range;

the clamp includes a pressure plate located between the roller and the platform, the clamp being adapted to move the pressure plate to engage one surface of the blade, thereby to force an opposite surface of the blade into contact with the platform;

the clamp includes at least one threaded stud fixed to the pressure plate, the stud passing freely through a registering hole defined by the platform, a hand-screw nut being located on the end of the stud where it projects beyond the platform; and the pressure plate has a convex surface adapted to engage the blade.

9. The device of claim 8, wherein the pressure plate has a concave surface facing but spaced away from the roller.

10. The device of claim 9, wherein the pressure plate is a sector of a cylinder.

11. A device for holding and positioning a tipped tool blade for sharpening the tip on a sharpening stone at a sharpening angle selected from a required range of sharpening angles, the device comprising:

a jig to hold the blade during sharpening in a position relative to the sharpening stone appropriate for the sharpening angle selected; and a reference member, to facilitate initial positioning of the blade relative to the jig in a position appropriate for the sharpening angle selected;

wherein, the jig comprises:

a platform;

a roller mounted on the platform for rotation about an axis and being adapted to roll on a sharpening stone during a sharpening operation;

a clamp adapted to hold the blade on the platform in a position in which the tip of the blade projects beyond the jig by a distance selected according to the sharpening angle selected; and wherein, the reference member is adapted to be located, for initial positioning of the blade relative to the jig, in a registration position relative to the jig;

the reference member has a first surface which bears a series of graduated markings in a zone which, when the reference member is in the registration position and during use of the device, is adjacent the tip of the blade so that the blade may be positioned relative to the jig with the tip of the blade located at a selected marking, the markings corresponding to different sharpening angles in the required range;

the reference member further having a second surface parallel to and opposite the first surface; and a batten configured to be gripped in a vice, the batten being attached to the second surface.

* * * * *